US009689162B2

(12) United States Patent
Cullen

(10) Patent No.: US 9,689,162 B2
(45) Date of Patent: Jun. 27, 2017

(54) INSULATING WALL ASSEMBLY WITH FRAMING MEMBER SUPPORTS PARTIALLY EMBEDDED WITHIN RIGID INSULATION PANELS

(71) Applicant: Bernard Ted Cullen, Winnipeg (CA)

(72) Inventor: Bernard Ted Cullen, Winnipeg (CA)

(73) Assignee: QUIK-THERM INSULATION SOLUTIONS INC., Winnipeg, Manitoba (CA)

( * ) Notice: Subject to any disclaimer, the term of this patent is extended or adjusted under 35 U.S.C. 154(b) by 0 days.

(21) Appl. No.: 14/929,805

(22) Filed: Nov. 2, 2015

(65) Prior Publication Data

US 2016/0130820 A1 May 12, 2016

Related U.S. Application Data

(60) Provisional application No. 62/077,515, filed on Nov. 10, 2014.

(51) Int. Cl.
*E04C 2/38* (2006.01)
*E04B 2/02* (2006.01)
(Continued)

(52) U.S. Cl.
CPC ..... *E04C 2/38* (2013.01); *E04B 2/02* (2013.01); *E04B 2/08* (2013.01); *E04C 2/00* (2013.01);
(Continued)

(58) Field of Classification Search
CPC ..... E04F 13/0801; E04F 13/0803; E04F 13/0805; E04F 13/0807; E04F 13/141;
(Continued)

(56) References Cited

U.S. PATENT DOCUMENTS 4,531,338 A * 7/1985 Donatt ..... E04F 13/0816 29/460
5,694,730 A * 12/1997 Del Rincon ..... E04B 1/6154 403/298
(Continued)

FOREIGN PATENT DOCUMENTS

AT DE 102015100678 A1 * 7/2016 ..... E04F 13/0807
CA 2820970 A1 * 9/2014 ..... E04F 13/0864
(Continued)

*Primary Examiner* — Babajide Demuren

(74) *Attorney, Agent, or Firm* — Kyle R. Satterthwaite; Ryan W. Dupuis; Ade & Company Inc.

(57) ABSTRACT

An insulating wall assembly features a plurality of insulation panels fitted together end-to-end and each having least one slot in a side thereof facing into an interior space of a building. At each slot, a respective set of supports each have an insertion portion engaged in the slot and a fastening portion reaching outwardly from said slot past the first face of the insulation panel. A respective framing member is fastened to each set of supports with a longitudinal dimension of said framing member running along the slot in which said set of supports are engaged. Each framing member has a first leg fastened face-to-face with the fastening portions of the respective set of supports and a second leg facing away from the insulation panels to present a surface for fastening of wall-finishing panels thereto. Holes in the supports accommodate electrical wiring or other lines within the finished wall assembly.

20 Claims, 6 Drawing Sheets

(51) Int. Cl.

| | |
|---|---|
| ***E04B 2/08*** | (2006.01) |
| ***E04C 2/00*** | (2006.01) |
| ***E04C 2/284*** | (2006.01) |
| ***E04F 13/08*** | (2006.01) |
| ***E04F 13/14*** | (2006.01) |

(52) U.S. Cl.
CPC ..... *E04C 2/284* (2013.01); *E04F 13/0807* (2013.01); *E04F 13/141* (2013.01); *E04B 2002/0252* (2013.01); *E04C 2002/001* (2013.01)

(58) Field of Classification Search
CPC ..... E04B 2/02; E04B 2/08; E04B 2002/001; E04B 2002/0252; E04C 2/284; E04C 2/38; E04C 2/00
USPC ..... 52/483.1, 489.1, 489.2
See application file for complete search history.

(56) References Cited

U.S. PATENT DOCUMENTS 6,067,765 A * 5/2000 Jones ..... E01C 3/006 52/309.12
6,263,638 B1 * 7/2001 Long, Sr. ..... B28B 19/003 52/309.11
6,729,094 B1 * 5/2004 Spencer ..... E04B 5/10 52/334
6,886,301 B2 * 5/2005 Schilger ..... E04C 2/205 52/302.1
8,033,065 B2 * 10/2011 Paetkau ..... E04B 1/14 52/220.1
8,272,182 B1 * 9/2012 Spiegel ..... E04B 1/24 52/404.2
8,397,465 B2 * 3/2013 Hansbro ..... E04H 5/10 52/309.14
8,567,145 B1 * 10/2013 Chauncey ..... E04B 1/7629 52/396.04
8,567,153 B1 * 10/2013 Francavilla ..... E04C 2/06 52/251
8,640,416 B2 2/2014 Cullen
8,769,901 B2 * 7/2014 Todd ..... E04F 13/0805 52/302.1
8,826,620 B2 * 9/2014 Krause ..... E04F 13/0817 52/235
8,898,984 B2 * 12/2014 Winteler ..... E04F 13/045 52/404.1
2003/0056456 A1 * 3/2003 Heydon ..... E04B 2/58 52/415
2003/0070379 A1 * 4/2003 Worley ..... E04B 1/762 52/506.05
2006/0265988 A1 * 11/2006 Fujito ..... E04F 13/0889 52/511
2011/0296781 A1 * 12/2011 McCary ..... E04C 2/292 52/309.2
2012/0042607 A1 * 2/2012 Chauncey ..... E04B 1/7629 52/745.21
2013/0318904 A1 * 12/2013 Miller ..... E04B 2/7411 52/483.1
2014/0075872 A1 * 3/2014 Mercado ..... E04B 2/58 52/309.9

FOREIGN PATENT DOCUMENTS

DE 29703013 U1 * 4/1997 ..... E04B 9/18
DE 102009003910 A1 * 8/2009 ..... E04F 13/007
DE 102012016025 A1 * 5/2014 ..... E04F 13/0807
DE 102014112987 A1 * 3/2016 ..... B32B 5/18
DK CA 2684085 A1 * 10/2008 ..... E04B 1/7637
IE CA 2801052 A1 * 12/2011 ..... E04B 2/90
IE CA 2893023 A1 * 6/2014 ..... E04B 2/721
SE WO 9205322 A1 * 4/1992 ..... E04B 1/90

* cited by examiner

A
A
10
12
14
16
18
20
22
24
26
28
32
34a
34b
36
46
56a
56b
62
100
G

B
B
C
C
12
16
26
32
34a
48a
50
56
56a
60
62
100

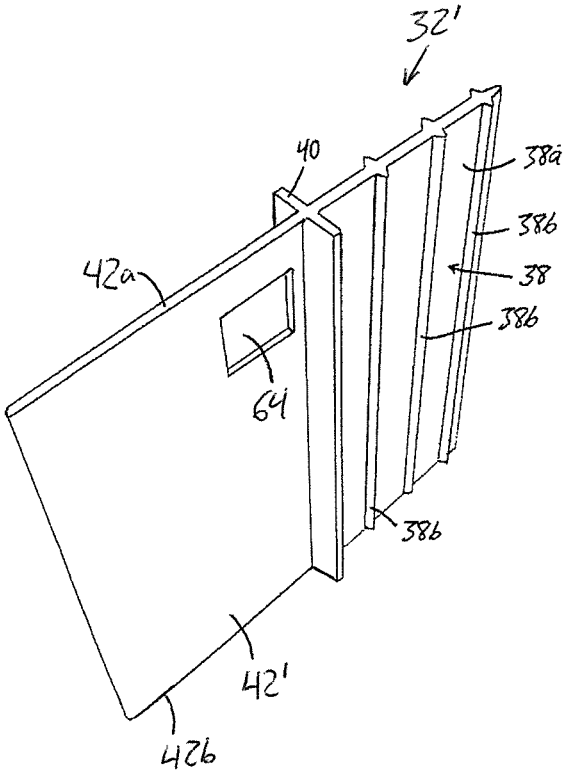
FIG. 9
FIG. 10
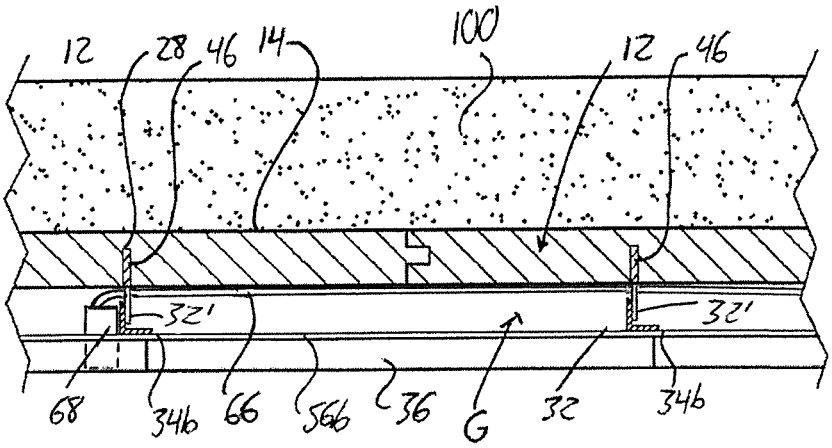

INSULATING WALL ASSEMBLY WITH FRAMING MEMBER SUPPORTS PARTIALLY EMBEDDED WITHIN RIGID INSULATION PANELS

CROSS REFERENCE TO RELATED APPLICATIONS

This application claims benefit under 35 U.S.C. 119(e) of Provisional Application Ser. No. 62/077,515, filed Nov. 10, 2014, the entirety of which is incorporated herein by reference.

FIELD OF THE INVENTION

The present invention relates generally to insulating wall assemblies in which framing members are attached to rigid insulation panels in order to support wall finishing panels at a spaced distance from interior faces of the rigid insulation panels, and more particularly to an insulating wall assembly of this type in which a plurality of supports are partially embedded into the insulation panels so to reach outward from the interior faces thereof for fastening of the framing members to these supports in an adjustable enabling plumb installation of the framing members.

BACKGROUND

Applicant's prior U.S. Pat. No. 8,640,416 discloses a concrete insulation system (CIS) for improving insulation of concrete walls e.g. foundation walls, by mounting rigid foam insulation panels over the interior surface of the concrete, while providing adjustable mounting of wall framing members that enables plumb positioning of same in order to attain a truly planar and vertical interior wall when drywall sheets or other wall finishing panels are mounted over the framing members.

In the aforementioned patent, framing members of T-shaped cross-section each had the web or stem of its T-shaped cross section adjustability received in a groove or slot of a respective foam post that was adhered to the concrete wall in a position matingly fitted between two adjacent insulation panels.

Applicant has developed a new CIS with a unique combination of elements that eliminates the need for foam posts between the adjacent insulation panels, and may be used to reduced the number of bulky components required to assemble the CIS, thereby improving the ease of installation and ease and cost of transport to the installation site.

SUMMARY OF THE INVENTION

According to a first aspect of the invention, there is provided an insulating wall system comprising:

a plurality of insulation panels each having interior first face for facing a first direction relative to an interior space of a building, an opposing second face for facing an opposite second direction relative to said interior space of the building, and at least one slot recessed into the body of insulation from the first face thereof and running longitudinally between a pair of opposing perimeter edges of said body of insulation;

a plurality of supports each having an insertion portion insertable into the slot of each insulation panel and a fastening portion arranged to project outwardly from the first face of said insulation panel with the insertion portion received in the slot of said insulation panel, whereby a series of framing members are fastenable to the fastening portions of the supports to define a framework on which wall finishing panels are mountable over the insulation panels at a spaced distance from the first face thereof.

Spray foam insulation may be sprayed into the slots of the insulation panels to secure the insertion portions of the supports within said slots.

Preferably the insertion portion of each support is barbed to resist withdrawal of said insertion portion from the slot in the insulation panels.

Preferably each slot runs longitudinally between opposing upper and lower perimeter edges of one of the insulation panels.

According to a second aspect of the invention, there is provided an insulating wall system comprising:

an insulating panel comprising:

a first face for facing a first direction relative to interior space of a building;

an opposing second face for facing an opposite second direction relative to said interior space of the building;

at least one support having one end anchored within the insulation panel and having a fastening portion projecting from the first face of the insulation panel to enable fastening of a framing member to the fastening portion of the support for subsequent mounting of a wall finishing panel to the frame member at a spaced distance from the first face of the insulation panel.

Preferably the system includes a plurality of framing members each having a longitudinal dimension and a cross-sectional shape in planes normal to said longitudinal dimension, said cross-sectional shape comprising a pair of diverging legs, including a fastening leg for fastening to fastening portion of the support in face-to-face relationship therewith, and a supporting leg carried by the fastening leg in a position lying cross-wise to the fastening portion so as to face away from the insulation panels to present a surface for fastening of the wall-finishing panels to the supporting legs of said plurality of framing members at a distance from the insulation panels.

Preferably each support comprises a positioning portion lying cross-wise to the insertion and fastening portions where said insertion and fastening portions join together, whereby abutment of said positioning portions of the supports against the first faces of the insulation panels denotes fully inserted positions of the supports within the slots of said insulation panels.

Preferably:

a plurality of the insulation panels are fitted together end-to-end with the first faces of said insulation panels facing the first direction relative to the interior space of the building and the opposing second faces facing the opposing second direction relative to said interior space of the building;

at each one of a plurality of spaced apart locations along the fitted together insulation panels, a respective set of the supports project from the first faces of the insulation panels at spaced apart positions along a linear path running between a pair of opposing perimeter edges of one of said insulation panels; and a respective framing member is fastened to each set of supports with a longitudinal dimension of said framing member running along the linear path of said set of supports, and each framing member, in planes normal to said longitudinal dimension, has a cross-sectional shape with a pair of diverging legs, a first one of said diverging legs being fastened face-to-face with the respective set of supports at the fastening portions thereof, and a second one of said diverging legs lying cross-wise to the first leg and facing away from the insulation panels to present a surface for fastening of the wall-finishing panel to said second one of the diverging legs.

Preferably each support has a pre-defined through-hole in the fastening portion thereof for routing of one or more lines therethrough in an assembled wall featuring said supports.

According to a third aspect of the invention, there is provided an insulating wall assembly comprising:

a plurality of insulation panels fitted together end-to-end with first faces of said insulation panels facing a first direction relative to an interior space of a building and an opposing second face facing an opposing second direction relative to said interior space of the building;

at each one of a plurality of spaced apart locations along the fitted together insulation panels, a respective set of supports projecting from the first faces of the insulation panels at spaced apart positions along a linear path running between a pair of opposing perimeter edges of one of said insulation panels, each support of said set having one end anchored within said one of the insulation panels;

a respective framing member fastened to each set of supports with a longitudinal dimension of said framing member running along the linear path of said set of supports, each framing member, in planes normal to said longitudinal dimension, having a cross-sectional shape with a pair of diverging legs, a first one of said diverging legs being fastened face-to-face with the respective set of supports at fastening portions thereof that project from the insulation panel, and a second one of said diverging legs lying cross-wise to the first leg and facing away from the insulation panels to present a surface for fastening of wall-finishing panels to said second one of the diverging legs.

Preferably each linear path runs longitudinally between opposing upper and lower perimeter edges of one of the insulation panels.

The fastening portion of each support may be slotted to allow insertion of the fastening leg of one of said framing members into said fastening portion.

The fastening portion of each support may comprise at least one line of weakness at which a thickness of the fastening portion is reduced to present a break-away or cut-away line for removal of a distal section of the fastening portion to reduce a length by which the fastening portion projects from the insertion portion.

Preferably each framing member is a right-angle channel.

Preferably the wall assembly further comprises an upper framing connector that is fastened to bottom edges of ceiling or floor joists and resides at a distance from the insulation panels on a side thereof faced by the first faces, the upper framing connector extending along the insulation panels and the framing members are fastened to the upper framing connector to hang therefrom.

Preferably the upper framing connector comprises a right angle channel member with one cross-sectional leg that is fastened to the bottom edges of the ceiling or floor joists, and another cross-sectional leg from which the framing members are hung.

Preferably each insulation panel has upright side edges that are configured with matingly shaped male and female features to enable fitting together of an adjacent pair of said plurality of insulation panels in end-to-end relation by mating of the male and female features of said adjacent pair of said plurality of adjacent insulation panels.

According to a third aspect of the invention, there is provided a method of assembling an insulating wall assembly, the method comprising:

providing a plurality of insulation panels each having a first face for facing into an interior space of a building, and an opposing second face for facing an opposite second direction relative to said interior space of the building;

providing a plurality of supports;

anchoring each support in one of the plurality of insulation panels such that one end of the support is anchored within the insulation panel and a fastening portion of the support extends outwardly away from the first face of the insulation panel, whereby the fastening portions of the supports are available for fastening of framing members thereto for subsequent mounting of wall finishing panels to the frame members at a spaced distance from the first faces of the insulation panels.

Preferably the step of anchoring each support comprises inserting the one end of each support into a slot that is recessed into the insulation panel at the first face thereof, said slot running longitudinally between a pair of opposing perimeter edges of said insulation panel.

The step of anchoring each support may comprise applying spray foam into the slot to embed the one end of the support within said spray foam, which sets in place within the slot to anchor the support to the insulation panel.

Preferably the step of anchoring each support is performed at a site of the building where the insulating wall assembly is to be installed.

Preferably the insulation panels are transported to the site of the building in a flat-stacked condition with one another at their first and second faces, prior to the step of anchoring each support.

Preferably the method comprises fitting the insulation panels together end-to-end at upright side edges thereof, and with the insulation panels fitted together and standing upright, fastening the framing members to the fastening portions of the supports to enable the subsequent mounting of wall finishing panels to the frame members.

Preferably, before fastening the framing members, (i) an upper framing connector is fastened to bottom edges of ceiling or floor joists at a distance from the upright-standing insulation panels on a side thereof faced by the first faces such that the upper framing connector extends along the insulation panels; and (ii) the framing members are suspended from the upper framing connector with lower ends of the framing members in free-hanging states allowing self-plumbing of the framing members under a pendulum-like movement relative to the upper framing connector prior to fastening of the framing members to the fastening portions of the supports.

Preferably the upper framing connector comprises a right angle channel, and the method comprises fastening one cross-sectional leg of the right angle channel to the bottom edges of the ceiling or floor joists, and hanging the framing members from the other cross-sectional leg of the right angle channel.

BRIEF DESCRIPTION OF THE DRAWINGS

Preferred embodiments of the invention will now be described in conjunction with the accompanying drawings in which:

FIG. 9 is a perspective view similar to FIG. 3, but showing a variant of the support clip which includes a through-hole therein for routing of electrical wiring or other lines within the insulating wall assembly.

FIG. 10 is a horizontal cross-section similar to FIG. 1, but illustrating use of the support clip of FIG. 9 to route electrical wiring in the insulating wall assembly.

In the drawings like characters of reference indicate corresponding parts in the different figures.

DETAILED DESCRIPTION

Figure 1:
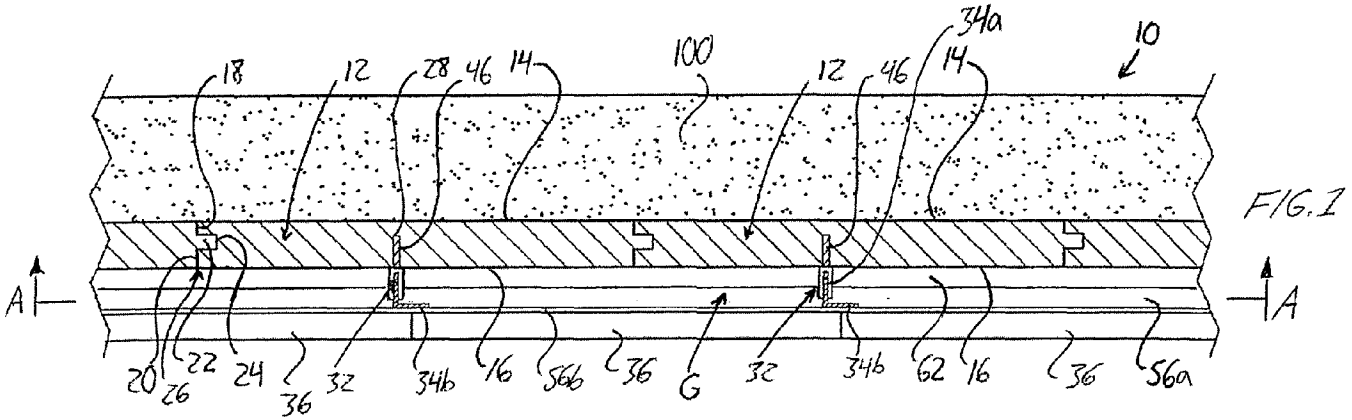
FIG. 1 is a horizontal cross-section of an insulating wall assembly according to one embodiment of the present invention, as viewed along line A-A of FIG. 2.

FIG. 1 illustrates a horizontal cross-section of an insulating wall assembly 10 according to an embodiment of the invention, as taken from a plane perpendicular to the major surfaces of a vertically-erect concrete foundation wall 100 of a building.

The insulating wall assembly 10, hereinafter also referred to as a "wall assembly" for brevity, includes a plurality of rigid foam insulation panels 12 each having a non-coated exterior face 14 that faces toward the concrete foundation wall 100 and away from an interior space of the building, an interior face 16 that faces away from the concrete foundation wall 100 into the interior space of the building and that is optimally coated with a reflective layer for enhancing the resistance to heat transfer such as through radiation. Perimeter edges of the panel include opposing top and bottom perimeter edges, and two opposing vertically upright side edges 18, 20. One of the upright side edges 18 features a male tongue 22 spanning the vertical length thereof and projecting laterally outward from the remainder of the side edge 18. The other upright side edge features a female groove 24 recessed therein and spanning the vertical length thereof. The tongue and groove are of mating size and shape, whereby insertion of the tongue of one of the panels 12 into an adjacent one of the panels cooperatively fits the tongue and groove together so as to join the adjacent panels together end-to-end in coplanar relationship with one another.

The joined together panels 12 are attached to the concrete foundation wall 100 by adhesive, or other suitable attachment means, in a position placing the exterior faces 14 of ten insulation panels 12 in abutment against the concrete foundation wall 100. The insulation panels each have the same uniform thickness between their interior and exterior faces 14, 16, and the mating tongue and groove at the interface 26 between each pair of adjacent panels maintains this uniform thickness so that the mating panels form a uniform layer of insulation over the interior surface 16 of the concrete foundation wall 100. This insulation layer is formed exclusively by the series of insulation panels 12, with no intermediates between them.

Each insulation panel 12, at one or more intermediate locations between the two upright side edges 18, 20 thereof, features a narrow elongated slot 28 of rectangular cross-section that runs linearly between a horizontal top edge of the panel and an opposing horizontal bottom edge thereof. The slot folllows a vertical path between these top and bottom perimeter edges, each of which spans between the two vertically upright side edges 18, 20 of the insulation panel so that these four perimeter edges cooperatively define the overall rectangular perimeter of the panel. The slot is recessed into the panel 12 from the interior face 16 thereof, with a depth that reaches partially through the panel toward the opposing exterior face 14, but stopping short thereof. In other words, the depth of the slot 28 is less than the thickness of the panel 12.

Figure 2:
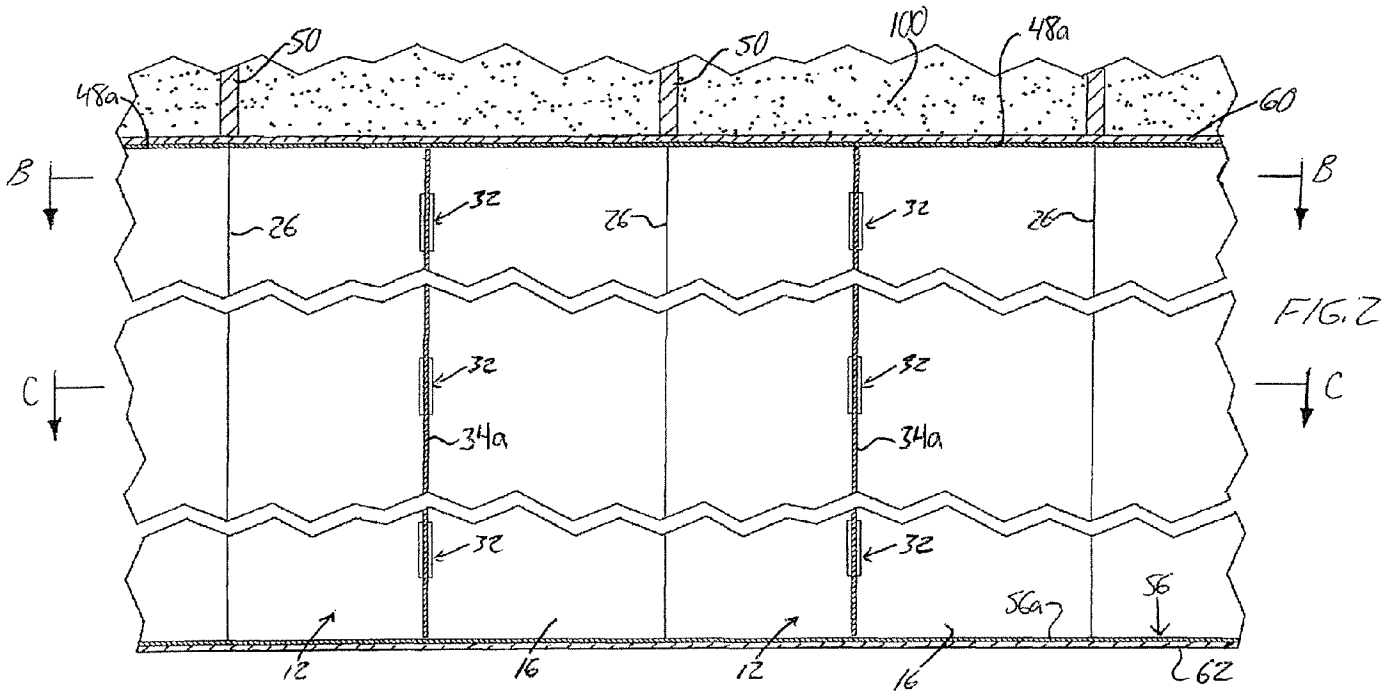
FIG. 2 is a vertical cross-section of the insulating wall assembly of FIG. 1, as viewed along line B-B thereof.

FIGS. 1 and 2 illustrate the wall assembly 10 in a fully installed state, in which a plurality of framing member support clips 32 have been anchored in each slot 2. In each slot 28, the respective set of support clips are vertically spaced from one another along the slot's linear path between the top and bottom perimeter edges of the panel. For each slot 28, a respective upright framing member 34 is provided in the form of a length of right-angle channel, and has one of its two cross-sectional legs 34*a* engaged with the respective set of clips 32 that are anchored in the slot 28. Accordingly, the longitudinal dimension of the framing member 34 stands vertically upright in front of the interior face 16 of the insulation panel 12. The second cross-sectional leg 34*b* of the framing member 34 lies perpendicularly cross-wise to the first leg 34*a* in cross-sectional planes of the framing member (i.e. planes lying normal to the longitudinal dimension of the framing member 34). This second cross-sectional leg 34*b* is situated at a distance spaced outwardly from the interior face 16 of the panel 12 past the distal ends of the clips 32 that project outward from the interior face 16 of the panel 12

With a series of framing members 34 installed in this manner so to reside at horizontally spaced intervals along the plane of the insulation panels 12, and with each framing member being carried by the clips 32 of a respective one of the slots 28, sheets or panels 36 of drywall or other wall finishing material can be fastened to the second legs 34*b* of the framing members in edge-to-edge relation with one another so as to form a generally continuous and planar finished interior wall surface of the wall assembly. The outer surface of the second cross-sectional leg 34*b* facing away from the interior face of the insulation panel presents a surface for placement and fastening of the drywall or other finishing panels. The framing members act to the space the wall finishing panels outward from the interior faces 16 of the insulation panels 12. This space between the insulation panels 12 and the wall finishing panels 36 may be left empty to define an airspace between them, or may be partially or entirely filled with additional layers of insulation material (e.g. fiberglass batt insulation). In either case, the air-filled or insulation-filled gap contributes to the thermal insulation performance of the wall assembly.

Figure 3:
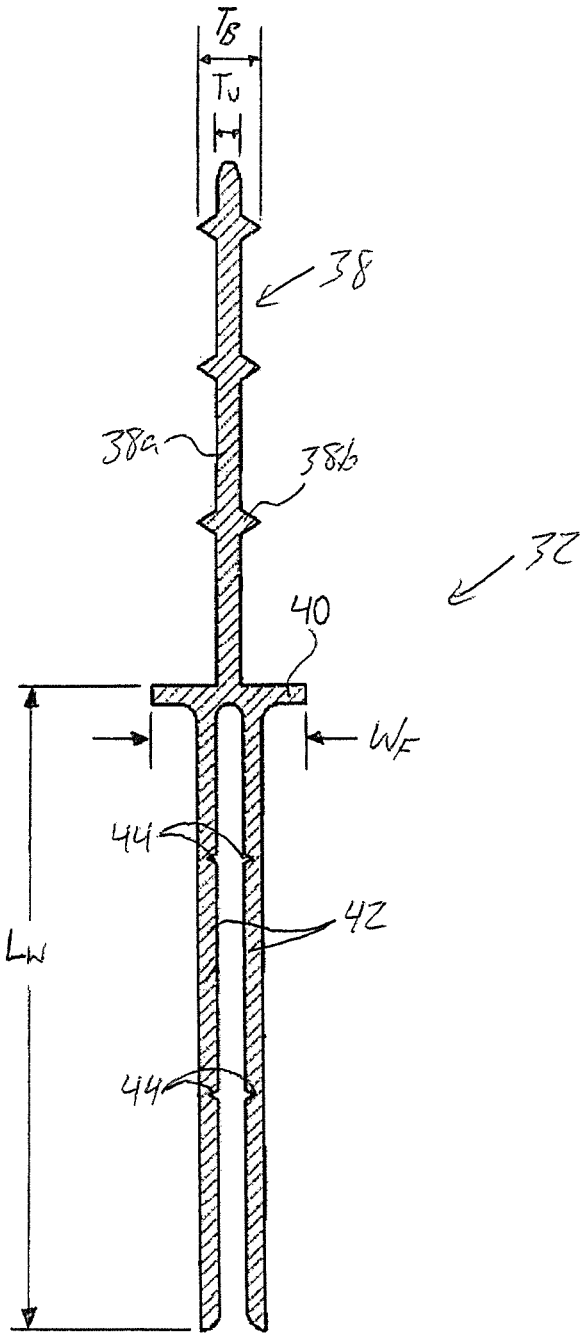
FIG. 3 is a horizontal cross-section of a framing member support clip of the insulating wall assembly, as viewed along line C-C of FIG. 2.
Figure 4:
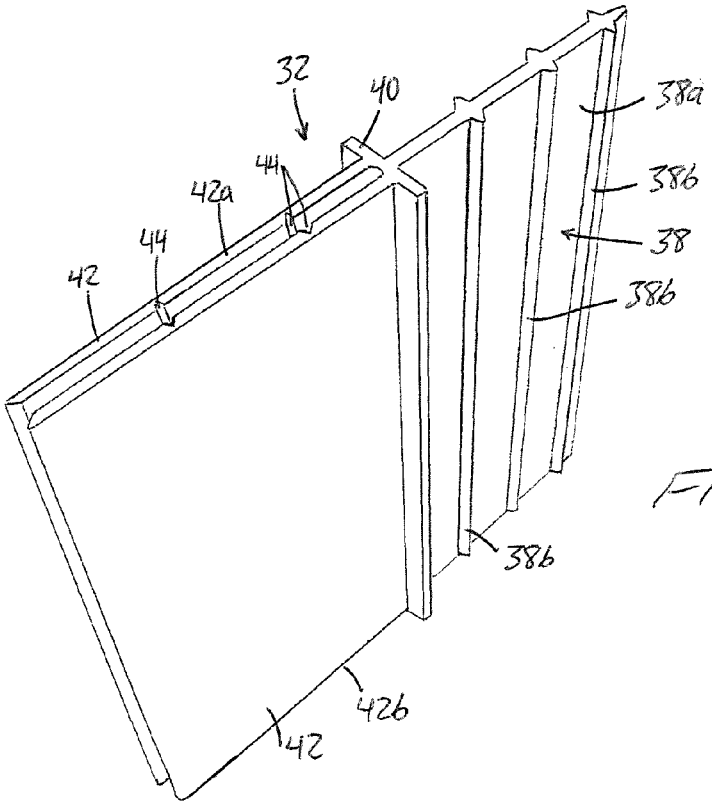
FIG. 4 is a perspective view of the framing member support clip of FIG. 3.

FIGS. 3 and 4 show one of the clips 32 in isolation, and disclose further detail of the clip structure than revealed by the schematically illustrated and partially embedded clips 32 of FIGS. 1 and 2. Each clip features a barbed fin 38 that forms an insertion portion of the clip 32 that is engaged into the respective slot 28 of the insulation panels 12 during assembly of the wall system. A thickness $T_U$ of the unbarbed areas 38*a* of the fin 38 is approximately equal to the width of the slots 28 in the insulation panels 12, which are preferably predefined slots created during manufacture of the panels 12. The barbs 38*b* that project laterally outward from the fin at spaced intervals therealong are dimensioned to allow the fin 38 to be manually forced into the slot, against the frictional resistance that is created between the tips of the barbs and the foam walls of the slot 28. After insertion of the clip 32 in the slot, there is enough interference between the tip-to-tip barb width $T_B$ of the clip and the predefined width of the panel slot 28 to frictionally hold the clip 32 in place at its inserted position in the slot, at least one a temporary basis. Accordingly, at the building site at which the insulating wall 10 is to be installed, an installer can manually insert a respective set of two or more clips into several slots (e.g. all the slots along a particular foundation wall that is to be insulated), before moving on to a next step of further anchoring the clips in place later, as described herein further below.

With continued reference to FIGS. 3 and 4, a stop flange 40 of the clip 32 lies perpendicularly to the barbed fin 38 at one end thereof, and projects laterally outward from both sides of the fin 38. A width $W_F$ of the stop flange 40 exceeds the width of the slot 28 in the insulation panel 12, whereby the stop flange 40 limits the distance by which the barbed fin 38 can be inserted into the slot. That is, once the fin 38 is fully inserted into the slot 28, the stop flange 40 abuts against the interior face 16 of the insulation panel 12 on either side of the slot 28 in order to prevent further penetration of the clip 32 into the insulation panel. The stop flange 40 thus defines a positioning portion of the clip that governs the fully inserted position of same.

On the side of the stop flange 40 lying opposite to the barbed insertion fin 38, the clip 32 features two clip walls 42 each lying parallel to the plane of the fin 38 on opposite sides thereof, and extending from the flange 40 in the direction opposite the fin. The space between the two clip walls 42 equals or slightly exceeds the thickness of the leg 34*a* of the framing member that is to be fastened to the clip 32, whereby this fastening leg 34*a* of the framing member can be slid into the space between the two clip walls 42 at the distal end of the clip. The space between the two clip walls 42 thus acts as a slot into which the fastening leg 34*a* of the framing member 34 is insertable, whereby the clip walls 42 define a slotted fastening portion of the clip 32. When the clip 32 is inserted in to one of the slots 28 in the insulation panels 12, the barbed fin 38 lies in the same vertical plane as the slot 28, and the clip walls 42 lie in respective vertical planes that are perpendicular to the interior face 16 of the insulation panels, parallel to the plane the slot 28, and located on opposing sides of the slot 28.

Each clip wall 42 features one or more lines of weakness 44 (specifically two such lines in the illustrated embodiment, although the number may vary) where the wall thickness is reduced relative to the remainder of the wall 42 in order to create a break-line or cut-line along which the wall 42 can be snapped or cut to reduce the length of the wall $L_W$, as measured from the stop flange 40. In the illustrated embodiment, each such line of weakness is formed by a v-shaped groove running perpendicularly from a top edge 42*a* of the wall 42 to an opposing bottom edge thereof 42*b* on an inner side of the respective clip wall 42 that faces the other clip wall 42. Alternatively, each line of weakness may be formed by a recess or groove on the outer side of the clip wall 42, or by a respective pair of recesses or grooves on both sides of the clip wall. A distal section of the clip wall 42 situated on the side of break or cut line 44 opposite the stop flange 40 can be snapped off (e.g. manually, or with the aid of tools, such as pliers) or cut off with a pair of scissors or tin snips, a utility knife, or the other cutting tool.

With reference to FIG. 1, this ability to reduce the wall length $L_W$ of the clip 32 can be used together with selection of angle shaped framing members 34 of shorter cross-sectional leg length to reduce the size of the air space or gap G between the interior faces 16 of the insulation panels 12 and the wall finishing panels 36. That is, trimming the wall length $L_W$ of the clips 32 shortens the distance by which the clips 32 extend from the interior face 16 of the insulation panels 12, and thus allows shortening of the distance by which the drywall support legs 34*b* of the framing members 34 are spaced from the insulation panels 12 in the finished wall assembly 10.

In the illustrated embodiment, the insertion fin 38 of the clip 32 is of flat plate-like or planar form, except at the barbs 38*a* thereof. As a result, a longitudinal dimension of the insertion fin 38 measured in the lengthwise direction of the slot 32 exceeds the thickness of the fin by several times, and a lengthwise span of the slot 32 occupied by the fin is therefore notably greater than that the slot width. Abutment of the opposing sides of this plate-like fin 38 with the opposing sides of the slot resists twisting of the clip about an axis normal to the interior surface of the insulation panels better than other clip embodiments featuring a post or shaft-like insertion portion whose dimensions across and along the slot are equal or similar to one another. The illustrated embodiment uses multiple clips per slot at vertically spaced positions therein, each clip being many times shorter than the slot in this longitudinal dimension. Another embodiment may instead employ a single clip of notably greater length in each slot to support the respective framing member over a substantial length thereof. However, using a set of two or more smaller clips provides sufficient support strength for the framing members, reduces the clip size for more convenient handling and more efficient transport, and reduces the overall material cost of the wall assembly.

After the clips 32 have been inserted into the slots 28, preferably during on-site installation of the wall assembly 10, the clips 32 are then anchored more securely and permanently to the insulation panels by application of spray foam insulation 46 into the slots, at least at the portions of the slots where the barbed insertion fins 38 of the clips 32 reside. The spray foam fills in any empty space between the insertion fin 38 and the foam walls of the slots 28. Allowed to set or cure, the spray foam bonds to the foam walls of the slots. As a result, the barbed insulation fin 38 of the clip 32 is now embedded within the resulting foam body made up of a combination of the insulation panel's original factory-provided foam content, and the hardened spray foam that was applied at the installation site. The clip 32 is therefore now firmly and permanently anchored to the insulation panel.

The clips 32 may be installed in the forgoing manner either before or after erection and attachment of the insulation panels 12 at the concrete foundation wall. After such erection and attachment of the insulation panels, and either before or after attachment of the clips 32 thereto, an upper frame connector 48 is installed in a position running horizontally parallel to the plane of the insulation panels 12 at short distance outward from the interior face 16 thereof at or near the plane of the of the top edges of the insulation panels 12. The upper frame connector 48 is secured in this position by fastening of the upper frame connector to a suitable overhead support structure, such as the bottom edges of a series of overhead floor or ceiling joists 50 that are situated above the insulation panels, as shown in FIG. 2. The upper frame connector 48 of the illustrated embodiment is made of the same right angle channel as the framing members 34, and has one cross-sectional leg 48*a* thereof fastened to the underside of the floor or ceiling joists 50. The other cross-sectional leg 48*b* of the upper frame connector 48 lies perpendicularly to the first leg 48*a*, and hangs downwardly therefrom.

Figure 7:
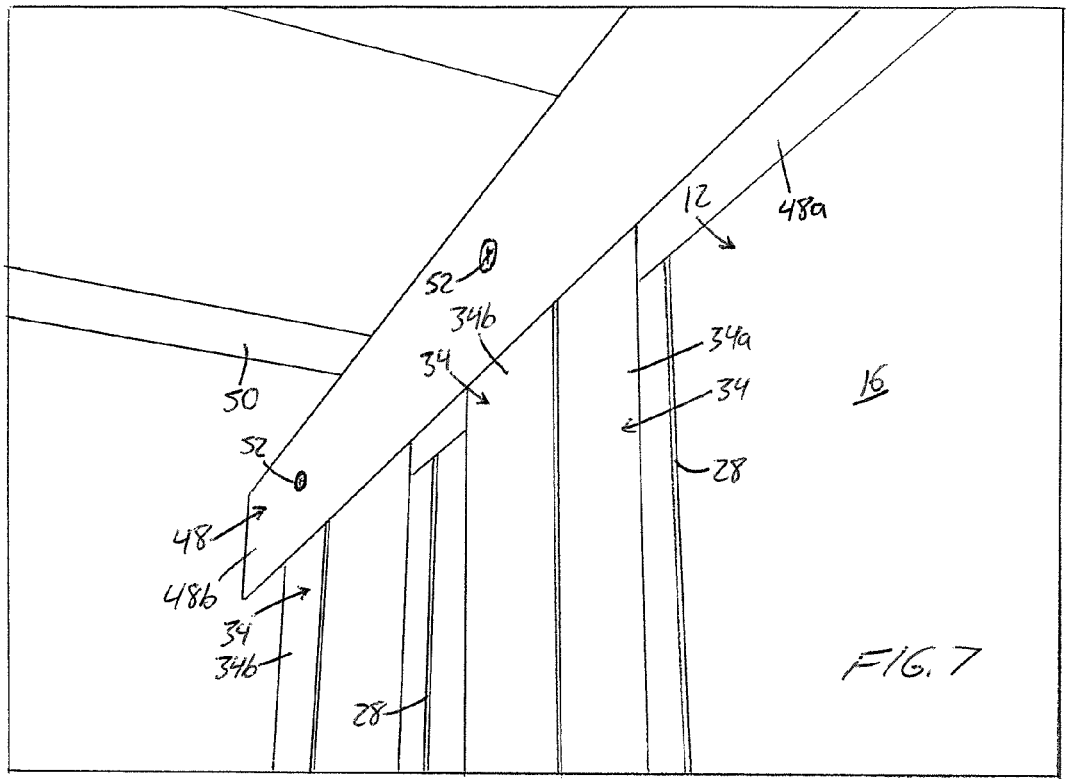
FIG. 7 is a perspective view showing fastened connection of the framing members of the insulating wall assembly to an upper framing connector that is fastened to the bottom edges of overhead floor or ceiling joists so as to run along the insulation panels near the top edge thereof at a spaced distance from the insulation panels.

With the upper framing connector 48 and the clips 32 both secured in place, each framing members 34 is then installed. To do this, the fastening leg 34*a* of the framing member is slid into the slotted space between the two clip walls 42 of each clip 32 in the respective slot 28 of the insulation panels, and in doing so the upper end of the frame member 34 is lifted up into the space between the insulation panels 12 and the hanging leg 48*b* of the upper framing connector 48. Here, the upper end of the drywall support leg 34*b* of the framing member is fastened to the hanging leg 48 of the upper framing connector 48 so as to hang the framing member 34 from the hanging leg 48*b* on the side thereof facing the insulation panels 12. This can be seen in FIG. 7 where screw 52 hangs the framing member 34 from the upper framing connector 48.

In this state, where the framing member is supported solely by this single-point fastening at the upper frame connector 48, the framing member 34 acts as a pendulum to self-plumb itself (i.e. self-align itself into a vertical orientation) in the plane of the slot 28, as the currently free-hanging bottom end of the framing member 34 will swing itself into vertical alignment below the fastened top end of the framing member. Under such pendulum-like action of the framing member 34, the fastening leg 34*a* of the framing member will swing toward or away from the stop flanges 40 of the respective set of clips within the slotted space between the clip walls 42 thereof.

Figure 5:
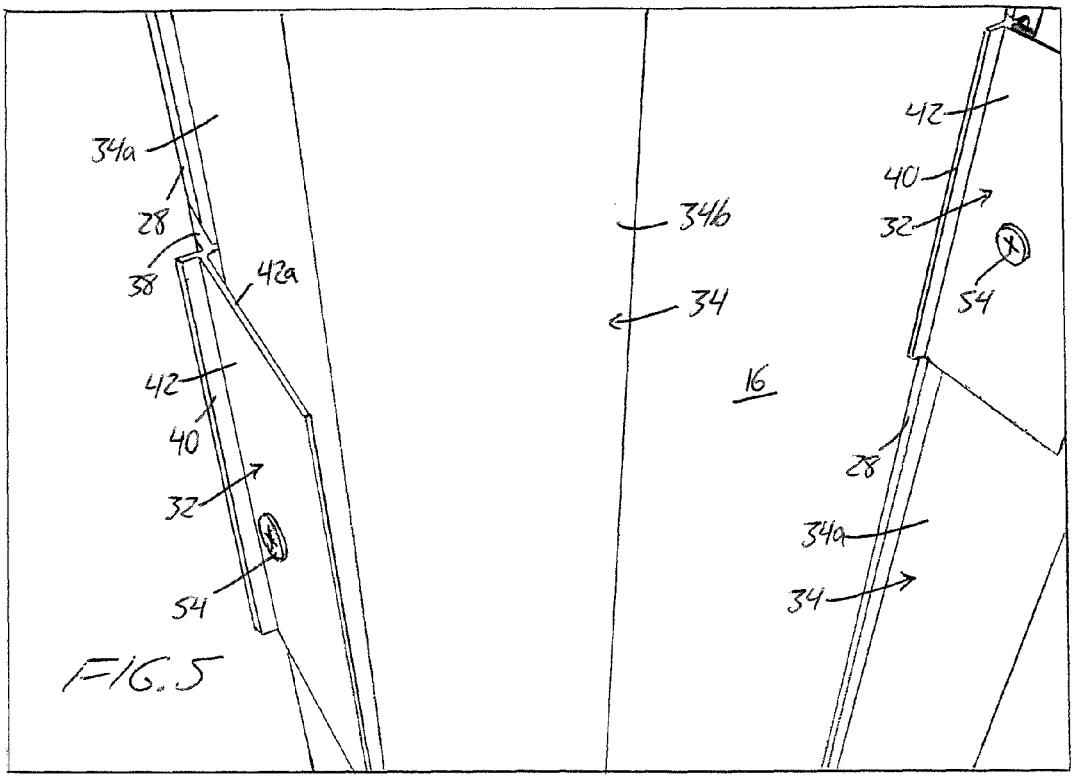
FIG. 5 is a perspective view illustrating a fastened connection of a right-angle framing member of the insulating wall assembly to one of the framing member support clips, as seen from one side of the framing member support clip.
Figure 6:
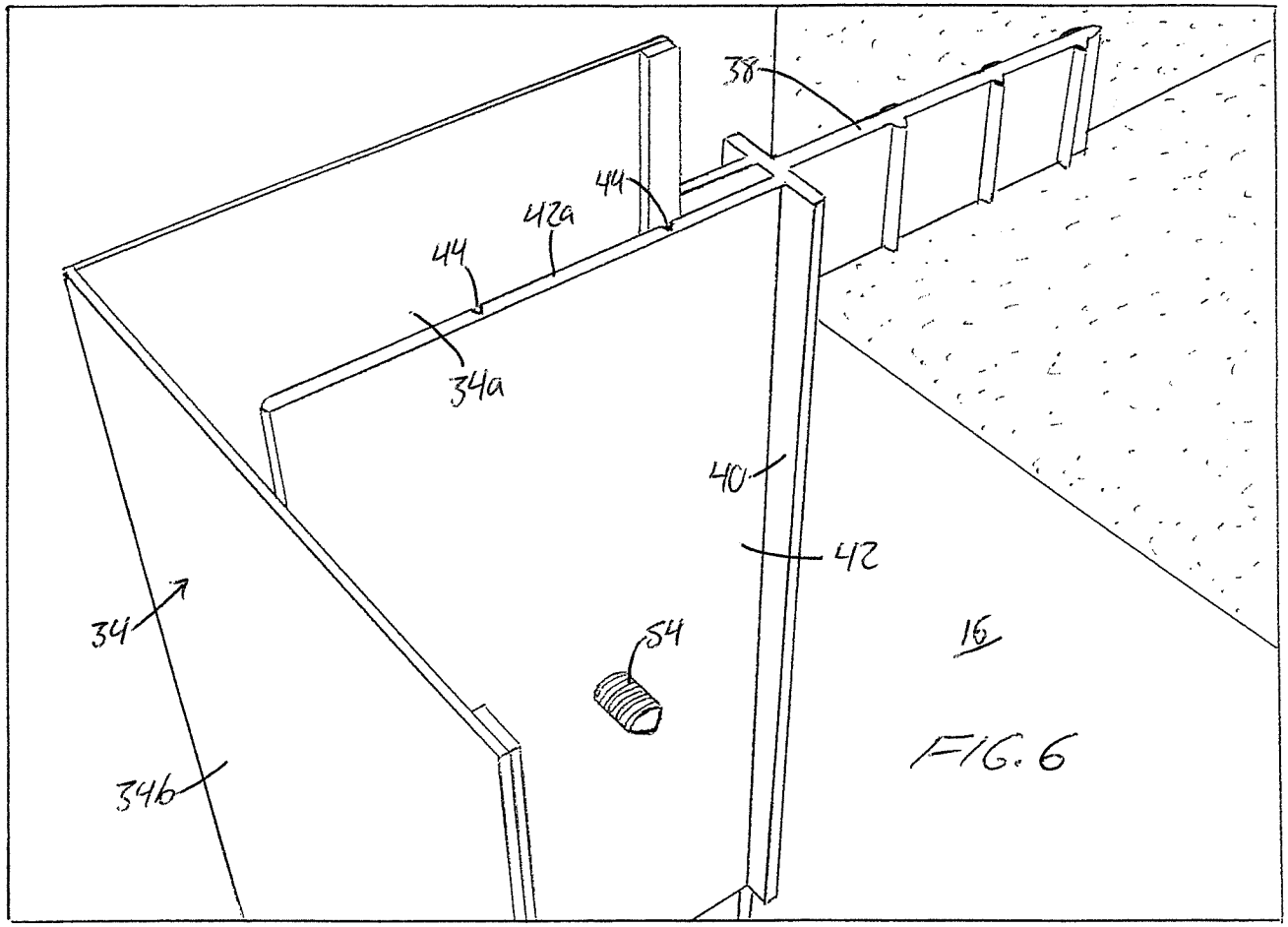
FIG. 6 is a perspective view illustrating the fastened connection of FIG. 5, as seen from an opposing side of the framing member support clip, but with an insulation panel of the insulating wall assembly partially cut away to show anchoring of the framing member support clip to the insulation panel by a barbed fin of the framing members support.

At this point, with the framing member hanging in a truly vertical orientation in the plane of the slot 28, regardless of whether the trueness of the insulation panel 12 in this plane, which may vary e.g. due to an uneven interior surface of the concrete foundation wall 100, the framing member 34 is then fastened to the respective set of clips 32. This can be seen in FIGS. 5 and 6 where a screw 54 has been driven through the two clip walls 42 of the clip 32, and in doing so, engages through the supporting fastening 34*a* of the framing member to fasten it in place within the slotted space of the clip 32.

Figure 8:
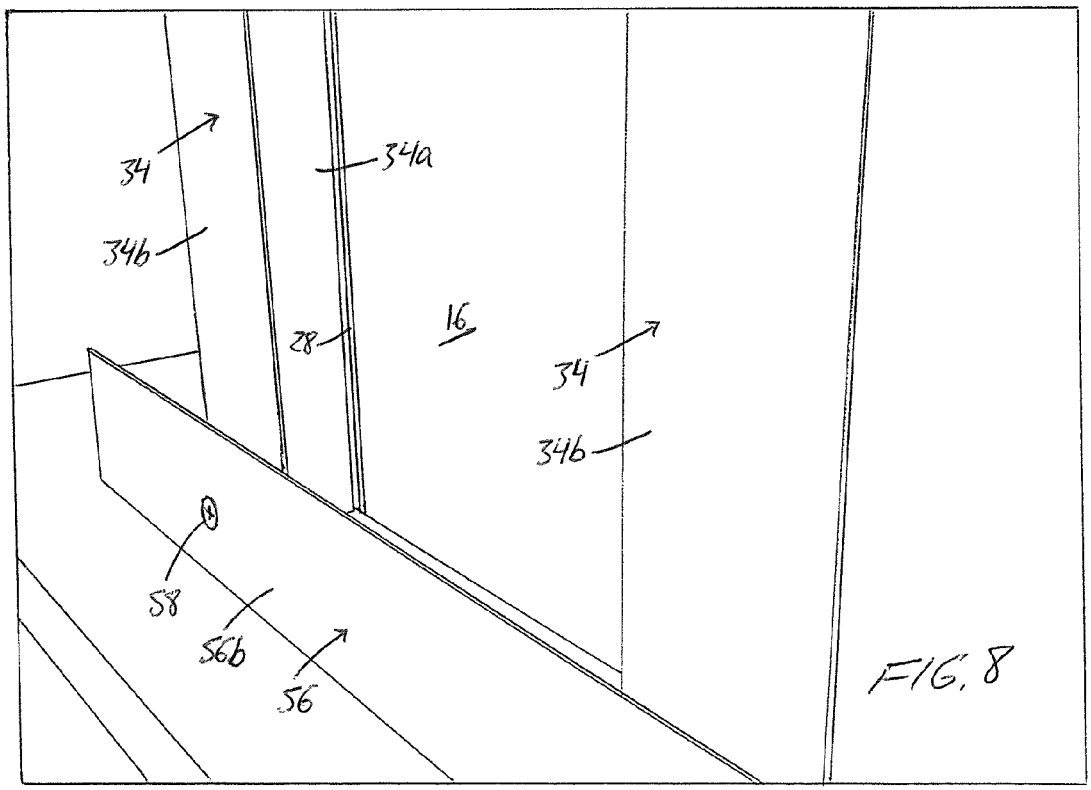
FIG. 8 is a perspective view showing fastened connection of the framing members of the insulating wall assembly to a lower framing connector that is fastened to the floor in parallel alignment with the upper framing member connector.

To further reinforce the installed positions of the framing members 34, a lower framing connector 56 is then added in order to join together the lower ends of the framing members 34 in a manner similar to that in which the upper framing connector 48 joins together the upper ends of the framing members. The illustrated lower framing connector 56 may be the same type of right angle channel as the upper framing connector 48. One of the lower connector's cross-sectional legs 56*a* is fastened to the floor so that it's other cross-sectional leg 56*b* stands upward therefrom, and the first cross-sectional leg 56*a* is slid into place the under the lower ends of the framing members 34 until the second cross-sectional leg 56*b* of the lower framing connector 56 abuts up against the drywall support legs 34*b* of the framing members 34. With the framing members self-plumbed into a proper vertical orientation, this will automatically align the lower framing connector 56 with the upper framing connector 48. The upstanding cross-sectional leg 56*b* is then fastened to the drywall support leg 34*b* of each framing member 34, as shown by screw fastener 58 in FIG. 8.

With the framing members and connectors all assembled in this manner to form a similar framework similar to a traditional stud wall (in which the framing members 34 correspond to the studs, and the upper and lower framing connectors 48, 56 correspond to the top and bottom plates), the framework is now ready for the mounting of drywall or other finishing panels 36 thereto. The drywall support legs 34*b* of the self-plumbing framing members 34 lie coplanar with one another in a vertical plane in order to support these finishing panels 36 in a proper coplanar, vertical condition for a flat and true finished wall. As shown in FIG. 1, the vertical edges of adjacent finishing panels 36 are abutted against one another in front of the drywall supporting leg 34 of one of the framing units for fastening of both panels to this same framing member. Additional fasteners may be used to secure the finishing panels 36 to the hanging leg 48*b* of the upper framing connector 48 near the top edges of the finished wall, and to the upstanding leg 56*b* of the lower framing connector 56 near the bottom edges of the finished wall.

The slots 28 in the insulation panels are preferably created during the manufacturing process, whereby an accurate linear path of the factory-defined slots ensures alignment of the clips 32 of each set with one another during on-site assembly, and installation time is reduced compared to other embodiments in which creation of clip-accommodating slots is instead performed on-site during the installation process. As an alternative to vertical slots 28 running between top and bottom edges of the insulation panels, horizontal slots could be employed to accommodate mounting of the clips, where one slot would accommodate a single clip in each set of vertically spaced clips to which a respective framing member is to be mounted. In another embodiment, instead of mounting multiple clips within an elongated slot spanning all or a substantially majority of the insulation panel, an array of recesses or openings at predefined positions spaced out over the interior faces of the insulation panels may be used to individually mount each support clip. As an alternative to using recesses or openings to accommodate mounting of the clips, other embodiments may embed the clips into the insulation panels as part of the manufacturing process. However, on-site post-manufacture installation of the clips is preferable due to the ability to flat-pack the insulation panels together at their interior and exterior for space and cost efficient transport and handling.

Although the framing member supports 32 are described above as clips due the dual-wall configuration 42 of the slotted fastening portion of the clip that embraces around both sides of the fastening leg 34*a* of the framing member, other embodiments may have a single wall effectively acting as a fastening flange that resides on only one side the fastening leg 34*a* of the framing member. In other words the fastening leg 34*a* of each framing member may be placed face-to-face beside a flat, unslotted fastening portion of a single wall support, or placed face-to-face with both walls of a slotted fastening portion like that of FIGS. 3 and 4.

In one embodiment, the air gap G in the finished wall assembly may preferably be approximately 2" wide to accommodate the installation of electrical boxes. In areas where electrical boxes are typically not located however, an air gap of approximately ¾" wide may be sufficient to provide a suitable insulating capacity. The foam core material of the insulating panels 12 may be Expanded Poly-Styrene ("EPS") foam sheets with a desirably sufficient insulation and R-value. In some embodiments, the exterior face of the foam panels in contact with the foundation wall may each optionally include a reflective layer such as a foil layer, similar to the reflective layer coated on the interior face of the foam panels, to act as a vapour barrier to resist the diffusion of moisture through the foundation wall, and to reduce radiative heat transfer from outside the structure during summer, for example.

The clips are preferably plastic, but may alternatively be formed of metal or other materials that would provide suitable support strength and allow fastening together of the clips and framing members. The framing members are preferably made of lightweight metal channel, but other materials may alternatively be employed. While the illustrated framing members are right-angle channel, other cross-sectional shapes also having divergent cross-sectional legs oriented at right-angles to one another may be employed. For example, T-shaped framing members of the shape disclosed in the Applicant's aforementioned patent may alternatively be used. However, right-angle channel reduces the material cost and weight of the framing member, and has the advantage that right-angle channel is readily and affordably available in the marketplace. As another alternative, closed rectangular channel members could be used, in which case adjacent sides of the channel form perpendicularly diverging legs of its cross-sectional shape for respective mating with the supports and drywall, but again, right-angle channel may be preferred in the interest of material efficiency.

FIGS. 9 and 10 illustrate an unslotted support 32' featuring a single-wall fastening portion 42'. As shown in FIG. 9, this support 32' features a through-hole 64 in the fastening portion 42' near the stop flange 40. Turning to FIG. 10, the through-hole 64 enables routing of electrical wiring 66 or other lines (e.g. speaker wire; or copper pipe, PEX tubing or other small plumbing conduits) through the air gap G behind the framing members 34, i.e. between the framing members 34 and the insulation panels 12. As shown, this enables an electrical line to run from one side of a framing member to another via the through-hole 64, for example to reach an electrical box (e.g. light switch, outlet or junction box) 68 mounted in the wall cavity between two adjacent framing members 34. The drawing illustrates one such example, in which the electrical box is fastened to the fastening leg of a respective framing member on the free side thereof facing away from the single-walled fastening portion 42' of the respective support 32'. It will be appreciated that the slotted support 32 of FIG. 4 may likewise be provided with a through-hole 64 opening through both walls of its fastening portion 42 for routing of electrical wiring or other lines through the support behind the respective framing member. The use of a pre-defined through hole in each support enables easy routing of utilities or the like without having do drill, cut, punch or otherwise create holes in the framing members, which also serves to better retain the structural integrity of the framing members.

Although disclosed in the context of a concrete insulating wall assembly, the invention may be employed in various applications to provide insulation capacity in various types of buildings, including concrete, steel, post frame, animal confinement, and quonset and tarp buildings, for example. Although the illustrated embodiment employs vertically oriented slots and framing members lying cross-wise to the top and bottom edges of the insulation panels, other embodiments may employ other orientations, while still providing a suitable framework for attachment of drywall or other finishing materials, such as horizontal slots and framing members spanning between the opposing upright side edges of the panels, or obliquely angled slots and framing members. However, vertically upright orientation of the framing members is preferred, at least partly due to the self-plumbing functionality achievable by hanging of such upright framing members from an upper framing connector.

The spacing between the slots 28, and the resulting spacing between the installed sets of clips and installed framing members may be varied. For example, insulation panels with predefined slots or pre-embedded support clips may employ known wall stud spacing values such as 16-inch or 24-inch, or for example employ 8-inch slot spacing from which the installer can choose to insert the sets of clips at 16-inch or 24-inch intervals according the regional standards or particular job requirements. The insulation panels may vary in size, and accordingly the number of slots or clip sets per panel may accordingly vary.

With reference to FIG. 2, in preferred embodiments, upper and lower foam gaskets 60, 62 are preferably employed between the top edges of the insulation panels 12 and the overhead ceiling or floor joists 50, and between the bottom edges of the insulation panels 12 and the underlying floor, which reduce the effects of floor heaving. The width dimension of each gasket 60, 62, measured perpendicularly from the interior surface of the foundation wall 100 exceeds the combined thickness of the insulation panels 12 and the air gap G measured in this same direction. As a result, the upper and lower framing connectors 48, 56 are fastened to the joists 50 and floor through the upper and lower gaskets 60, 62, respectively, and the top and bottom of the air gap G are sealed off by the gaskets. The gaskets preferably have the same reflective coating as the insulation panels. The gaskets reduce convection flow in the air cavity, which in conjunction with the reflective surfaces, enhances the overall effective R-value significantly.

Although the illustrated embodiment is described as a concrete insulation system installed on the interior of a concrete wall, the insulating wall assembly may be installed in other contexts, regardless of the presence of a concrete wall. In one embodiment, where the insulation panels do not internally line a concrete wall or other structure, the insulation panels may be installed with the slotted-faces of the insulation panels facing outwardly away from the interior space of the building toward the exterior environment. This way, the installation of the framing member support clips and associated framing members on the exterior side of the insulation panels can be used to form a rainscreen, where the slotted exterior face (preferably coated in the manner described herein above) forms a drainage plane, and the support clips and installed framing members create an airspace between the drainage plane and one or more exterior finishing layers mounted on the framing members. Accordingly, the slotted first faces of the insulation panels may face into the interior space of the building, as in the illustrated embodiment, or may face away from the interior space of the building in other embodiments. Likewise, the wall finishing panels may be interior finishing panels such as drywall, or exterior panels such as exterior sheathing onto which additional exterior finishing layers (e.g. siding) can be mounted. Alternatively, wall finishing panels for exterior applications may be the actual finishing layer material itself, it if is suitable for mounting directly to the framing members without an underlying layer of sheathing material.

Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

The invention claimed is:

1. An insulating wall system comprising:

a plurality of insulation panels each having interior first face for facing a first direction relative to an interior space of a building, an opposing second face for facing an opposite second direction relative to said interior space of the building, and at least one slot recessed into the body of insulation from the first face thereof and running longitudinally between a pair of opposing perimeter edges of said body of insulation, said slot having a slot length measured longitudinally between said pair of opposing perimeter edges;

a plurality of supports each having an insertion portion insertable into the slot of each insulation panel and a fastening portion arranged to project outwardly from the first face of said insulation panel with the insertion portion received in the slot of said insulation panel, whereby a series of framing members are fastenable to the fastening portions of the supports to define a framework on which wall finishing panels are mountable over the insulation panels at a spaced distance from the first face thereof; and a plurality of framing members defined separately of the plurality of supports for subsequent fastening thereto during assembly;

wherein a longitudinal dimension of each support is multiple times shorter than said slot length and is arranged to lie parallel to the slot length when inserted in the slot, and a longitudinal dimension of each framing member is multiple times longer than longitudinal dimension of each support, whereby multiple supports are receivable in the slot at spaced apart locations along the slot length to receive fastening of a singular one of said framing members to said multiple supports at said spaced apart locations along the slot length.

2. An insulating wall system comprising:

a layer of insulating panels placed against a wall of a building and comprising:

a first face facing a first direction relative to interior space of the building;

an opposing second face facing an opposite second direction relative to said interior space of the building; and a pair of opposing perimeter edges separated from one another in a longitudinal direction by a length dimension;

a set of supports each having one end anchored within the insulation panel and having a fastening portion projecting from the first face of the layer of insulation panels;

a framing member defined separately of the set of supports for subsequent fastening thereto during assembly;

wherein a longitudinal dimension of each support lies parallel to the longitudinal direction in which the opposing perimeter edges of the insulating panel are separated, said longitudinal dimension of each support is multiple times shorter than said length dimension of said layer of insulating panels, a longitudinal dimension of each framing member is multiple times longer than longitudinal dimension of each support, and the set of supports reside at spaced apart locations along the length dimension of the layer of insulating panels, whereby the framing member is fastenable to said set of supports at the spaced apart locations along the length dimension of the insulating panel.

3. The insulating wall system of claim 1 wherein the framing member has a cross-sectional shape in planes normal to said longitudinal dimension of the framing member, said cross-sectional shape comprising a pair of diverging legs, including a fastening leg for fastening to the fastening portions of the supports in face-to-face relationship therewith, and a supporting leg carried by the fastening leg in a position lying cross-wise to the fastening portion so as to face away from the insulation panels to present a surface for fastening of the wall-finishing panels to the supporting legs of said plurality of framing members at a distance from the insulation panels.

4. The insulating wall system of claim 1 further comprising spray foam insulation sprayable into the slots of the insulation panels to secure the insertion portions of the supports within said slots.

5. The insulating wall system of claim 1 wherein the insertion portion of each support is barbed to resist withdrawal of said insertion portion from the slot in the insulation panels.

6. The insulating wall system of claim 1 wherein each support comprises a positioning portion lying cross-wise to the insertion and fastening portions where said insertion and fastening portions join together, whereby abutment of said positioning portions of the supports against the first faces of the insulation panels denotes fully inserted positions of the supports within the slots of said insulation panels.

7. The insulating wall system of claim 1 wherein each support has a pre-defined through-hole in the fastening portion thereof for routing of one or more lines therethrough in an assembled wall featuring said supports.

8. The insulating wall system of claim 2 wherein:

at each one of a plurality of spaced apart locations along the layer of insulation panels, a respective set of supports project from the first faces of the insulation panels at spaced apart positions along a linear path running between the pair of opposing perimeter edges of one of said insulation panels; and a respective framing member is fastened to each set of supports with the longitudinal dimension of said framing member running along the linear path of said set of supports, and each framing member, in planes normal to said longitudinal dimension thereof, has a cross-sectional shape with a pair of diverging legs, a first one of said diverging legs being fastened face-to-face with the respective set of supports at the fastening portions thereof, and a second one of said diverging legs lying cross-wise to the first leg and facing away from the insulation panels to present a surface for fastening of the wall-finishing panel to said second one of the diverging legs.

9. The insulating wall system of claim 8 wherein each linear path runs longitudinally between opposing upper and lower perimeter edges of the layer of insulation panels.

10. The insulating wall system of claim 3 claim wherein each framing member is a right-angle channel.

11. The insulating wall system of claim 8 wherein the wall assembly further comprises a lower framing connector that is fastened atop a floor surface and resides at a distance from the layer of insulation panels on a side thereof faced by the first face, the lower framing connector extending along the layer of insulation panels and the framing members being fastened to the lower framing connector in positions standing upright therefrom.

12. The insulating wall system of claim 11 wherein the lower framing connector comprises a right angle channel member with one cross-sectional leg that is fastened to the floor surface, and another cross-sectional leg standing upright from the floor surface and having the framing members fastened thereto.

13. A method of assembling an insulating wall assembly, the method comprising:

placing a layer of insulation panels against a wall with a first face of said layer facing away from said wall into an interior space of a building, an opposing second face of said layer facing toward said wall in an opposite second direction relative to said interior space of the building, and with opposing perimeter edges of said layer of insulation panels separated from one another in a longitudinal direction by a length dimension;

providing a set of supports each having a longitudinal dimension multiples times shorter than said length dimension of the layer of insulation panels;

anchoring the set of supports in the layer of insulation panels such that the longitudinal dimension of each support lies in the longitudinal direction of the layer of insulation panels, the set of supports are spaced apart from one another along the length dimension of the layer of insulation panels, one end of each support is anchored within the layer of insulation panels and a fastening portion of each support extends outwardly away from the first face of the layer of insulation panels; and with the set of supports already anchored in the insulation layer, fastening a singular framing member to the set of supports so that the singular framing member is carried at a spaced distance from the layer of insulation panels and is respectively supported by the set of support members at the spaced apart positions along the length dimension of the layer of insulation panels.

14. The method of claim 13 wherein the step of anchoring each support comprises inserting the one end of each support into a slot that is recessed into the layer of insulation panels at the first face thereof, said slot running longitudinally between the opposing perimeter edges of said layer of insulation panels.

15. The method of claim 14 wherein the step of anchoring each support further comprises applying spray foam into the slot to embed the one end of the support within said spray foam, which sets in place within the slot to anchor the support to the insulation panel.

16. The method of claim 13 comprising (i) fastening a lower framing connector to a floor surface at a distance from the layer of insulation panels on a side thereof faced by the first face such that the lower framing connector extends along the layer of insulation panels; and (ii) fastening a free-hanging lower end of the framing member to the lower framing connector.

17. The method of claim 16 wherein the lower framing connector comprises a right angle channel, and the method comprises fastening a first cross-sectional leg of the right angle channel to the floor surface to place a second cross-sectional leg of the right angle channel in a position standing upright therefrom, and fastening the framing member to the second cross-sectional leg of the right angle channel.

18. The system of claim 1 wherein the framing members are metal and the supports are plastic.

19. The system of claim 2 wherein the framing members are metal and the supports are plastic.

20. The method of claim 13 wherein the framing member is metal and the supports are plastic.

* * * * *